US009039541B2

(12) United States Patent
De Vries et al.

(10) Patent No.: US 9,039,541 B2
(45) Date of Patent: May 26, 2015

(54) METHOD FOR LAYING A PLAYABLE SURFACE, FOR INSTANCE A PLAYING FIELD, AND SURFACE THUS FORMED

(76) Inventors: Hugo De Vries, GS Ridderkerk (NL); Pieter Rook, AL Ridderkerk (NL)

( * ) Notice: Subject to any disclaimer, the term of this patent is extended or adjusted under 35 U.S.C. 154(b) by 0 days.

(21) Appl. No.: 13/368,147

(22) Filed: Feb. 7, 2012

(65) Prior Publication Data

US 2012/0190464 A1 Jul. 26, 2012

(51) Int. Cl.

| | |
|---|---|
| ***A63J 3/00*** | (2006.01) |
| ***E01C 13/08*** | (2006.01) |
| ***E01C 13/02*** | (2006.01) |

(52) U.S. Cl.
CPC ..... *E01C 13/08* (2013.01); *E01C 13/02* (2013.01)

(58) Field of Classification Search
USPC ..... 472/92
See application file for complete search history.

(56) References Cited

U.S. PATENT DOCUMENTS

| | | | | |
|---|---|---|---|---|
| 4,007,307 | A * | 2/1977 | Friedrich | 428/17 |
| 4,318,248 | A | 3/1982 | Muldner | |
| 4,790,531 | A * | 12/1988 | Matsui et al. | 472/90 |
| 4,957,788 | A | 9/1990 | Colonel et al. | |
| 5,254,039 | A * | 10/1993 | Garcia | 472/92 |
| 5,460,867 | A * | 10/1995 | Magnuson et al. | 428/178 |
| 5,853,265 | A | 12/1998 | Gunter | |

FOREIGN PATENT DOCUMENTS

| | | |
|---|---|---|
| DE | 1 933 048 | 1/1970 |
| WO | WO 93/01356 | 1/1993 |

OTHER PUBLICATIONS

US Supplemental Notice of Allowance dated Jan. 6, 2012 for U.S. Appl. No. 10/522,795.
US Notice of Allowance dated Nov. 7, 2011 for U.S. Appl. No. 10/522,795.
US Office Action dated Feb. 8, 2011 for U.S. Appl. No. 10/522,795.
US Office Action dated Jul. 12, 2010 for U.S. Appl. No. 10/522,795.
US Office Action dated Nov. 20, 2009 for U.S. Appl. No. 10/522,795.
US Office Action dated Jan. 16, 2009 for U.S. Appl. No. 10/522,795.
US Office Action dated Jun. 5, 2008 for U.S. Appl. No. 10/522,795.

* cited by examiner

*Primary Examiner* — Michael Dennis
(74) *Attorney, Agent, or Firm* — Harness, Dickey & Pierce, P.L.C.

(57) ABSTRACT

The invention relates to a method for laying a playable surface such as playing field, comprising the steps of forming a hard substrate, arranging on the hard substrate a layer of resilient and/or damping material, and arranging a top layer on the resilient and/or damping layer, wherein during or after arranging of the hard substrate and/or the reliant and/or damping layer air chambers are formed therein. The behavior of the playing field becomes more natural due to these air chambers, and excessive resilience and energy restitution are avoided. The air chambers can be formed for instance by creating recesses in the relevant layer from the top, or by removing material from the layer at different location after arranging thereof, for instance by melting or biological decomposition of inclusions. The invention also relates to playing field obtain by application of this method.

16 Claims, 2 Drawing Sheets

METHOD FOR LAYING A PLAYABLE SURFACE, FOR INSTANCE A PLAYING FIELD, AND SURFACE THUS FORMED

CROSS-REFERENCE TO RELATED APPLICATIONS

This application is a divisional of U.S. application Ser. No. 10/522,795, filed on Jan. 31, 2005, which is a national stage entry of International Application No. PCT/NL03/00542, filed on Jul. 24, 2003, which claims the benefit of the Netherlands Patent Application No. 1021171, filed on Jul. 29, 2002, in the Netherlands Intellectual Property Office, the disclosure of each of which is incorporated by reference herein in their entirety.

BACKGROUND OF THE INVENTION

Field of the Invention

The invention relates to a method for laying a playable surface, in particular a playing field, comprising the steps of:

forming a relatively hard substrate, arranging on the relatively hard substrate at least one layer of a resilient and/or damping material, and arranging a top layer on the at least one layer of resilient and/or damping material. Such a method is generally known and is applied on large scale to form playing fields, for instance synthetic turf fields for sport and recreation. Synthetic turf the form of a mixture consisting of plastic or rubber granules or particles which are held together by a binder, or in the form of solid material supplied on rolls, for instance a closed or open-cell foam. The resilient and/or damping material is arranged or unrolled on-site on the substrate, whereafter it is covered by the top layer, for instance a synthetic turf.

The known method has the drawback that the thereby formed playing field is often perceived as being too "bouncy" and has too great an energy restitution. The behaviour of a ball is adversely affected by the large spring force of the resilient layer in the sense that a ball bounces too fast and too high compared to a natural turf. In addition, walking or running over such a resilient synthetic turf field is very tiring and unnatural.

SUMMARY OF INVENTION

The invention therefore has for its object to provide a method which results in a playing field, in particular a synthetic turf field, which more closely resembles a natural turf field than the synthetic turf fields laid heretofore, which enables a better ball behaviour and which does not result in excessive fatigue when playing on the field. According to the invention this is achieved in a method of the above described type in that, during or after arranging of the relatively hard substrate and/or the layer of resilient and/or damping material, air chambers are formed therein. As a result of the air chambers in the layer of resilient and/or damping material, or even in the relatively hard substrate, movements on the synthetic turf field are damped. Balls for instance hereby do not bounce too high, and walking or running over the synthetic turf also feels natural. By further forming the air chambers during or after laying of the resilient and/or damping layer or the hard substrate, these layers do not need to be manufactured from specially preprocessed material, and relatively simple, and therefore not very costly materials can be used for this purpose.

A preferably applied variant of the method consists of the air chambers being formed in the relatively hard substrate and/or the layer of resilient and/or damping material by creating recesses therein from the top side after it is arranged. The arranging of recesses from the top can be carried out quickly and with relatively simple means. The recesses are preferably created by moving a machine provided with protruding parts over the relatively hard substrate and/or the layer of resilient and/or damping material. By using for instance a pressure roller provided with studs as machine, the recesses can be formed simultaneously with pressing down of the substrate or resilient and/or damping layer, whereby no additional operation is necessary.

In addition, it is also possible to create the recesses by pressing a profiled mat into the layer of resilient and/or damping material. A mat is here understood to mean any relatively thin closed material, for instance a woven fabric, a non-woven, a foil and the like. A simple, smooth roller can in this case be used.

It is on the other hand also possible to envisage the air chambers being formed in the layer of resilient and/or damping material by removing material therefrom at different locations after the arranging thereof. A simple method of forming the required air chambers in precisely controlled manner consists of inclusions of a material with low melting point being arranged in the layer of resilient and/or damping material which are removed by heating after the layer has been arranged. According to a variant, inclusions of a biologically degradable material are arranged in the layer of resilient and/or damping material which are removed by natural processes after the layer has been arranged. In this manner the air chambers are created automatically after a period of time without any operations being necessary for this purpose.

According to yet another variant of the method according to the invention, the air chambers are formed in the layer of resilient and/or damping material during arranging thereof by including granules having large dimensions relative to the thickness of the layer. The air chambers can thus be formed by replacing a part of the resilient and/or damping material with material of a considerably larger size, whereby the degree to which the resilient and/or damping layer is filled will decrease greatly as a result of the poorer fit of the large granules, without additional operations being necessary for this purpose. In that case the layer of resilient and/or damping material can for instance be arranged in two steps, by first arranging a relatively flat adhesive layer of material on the relatively hard substrate, and subsequently spreading the granules with large dimensions over the adhesive layer.

Finally, it is also conceivable for the air chambers to be formed in the layer of resilient and/or damping material during arranging thereof by first laying a profiled mat on the relatively hard substrate, and by spreading the resilient and/or damping material over this mat. Such a profiled mat in fact already contains the air chambers, so that the resilient and/or damping material need only be placed thereover and spread to form a layer which is flat on the upper side. Prior to arranging of the mat, heating wires can advantageously be received therein, so that the mat can also serve as ground heating.

In the case use is made of a profiled mat, this mat can otherwise be manufactured from a biologically degradable material or from a material with a low melting point. After forming of the playing field the mat can thus decompose in natural manner or be removed by heating.

In order to nevertheless form a very flat upper layer on which the synthetic turf can be laid, this despite the presence of the air chambers, at least one other layer can also be arranged between the layer with the air chambers and the synthetic turf. This layer can for instance serve to distribute the load on the top layer uniformly into the substrates, or can serve for additional resilience and/or damping.

When a synthetic turf is placed as top layer, a synthetic turf field is formed with the method according to the invention which has a very natural feel.

At least some of the air chambers are advantageously connected to means for generating an air circulation therein. Warm air for instance can thus be blown under the playing field, whereby a simple and effective ground heating is obtained.

The invention further relates to a playable surface, in particular a playing field, comprising a relatively hard substrate, at least one layer arranged thereon of a resilient and/or damping material, and a top layer arranged in turn thereon. Such a surface, for instance in the form of a synthetic turf field, is likewise generally known, and has the above discussed drawbacks.

The invention has for its object to further improve a playable surface of the stated type. According to the invention this is achieved in such a surface by air chambers formed in the relatively hard substrate and/or the layer of resilient and/or damping material.

BRIEF DESCRIPTION OF THE DRAWINGS

Preferred embodiments of the playable surface according to the invention are described in the dependent claims.

The invention is now elucidated on the basis of a number of embodiments, wherein reference is made to the annexed drawing, in which.

DETAILED DESCRIPTION

Figure 1:
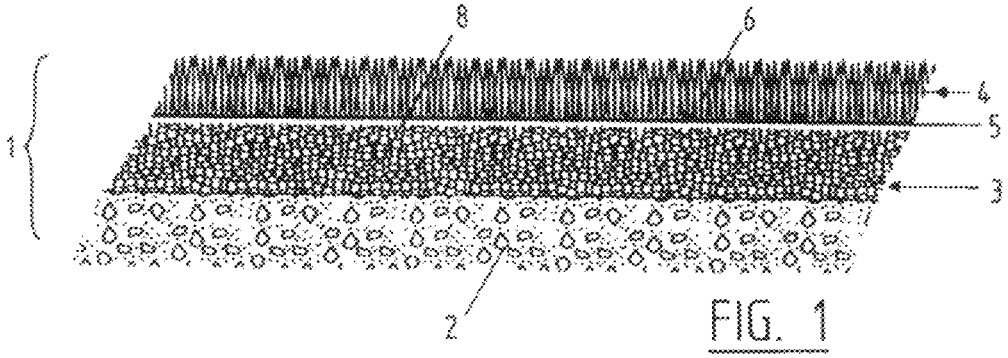
FIG. 1 is a schematic cross-section showing the structure of a prior art playing field.

A playable surface, for instance a prior art synthetic turf field 1 (FIG. 1) is formed by a relatively hard substrate 2, for instance of asphalt or stone chippings, over which a flat layer of resilient and/or damping material 3 is arranged. This resilient and/or damping layer 3 can have a thickness of about 10 to 40 mm. Arranged on the resilient and/or damping layer 3 is a top layer 4, here in the form of a synthetic turf consisting of a backing 5 and synthetic grass blades 6 connected thereto by tufting, knitting or weaving.

The resilient and/or damping layer 3 can be formed in different ways. It is for instance known to use a mixture of rubber granules 8 with relatively small dimensions, in the order of several millimeters, for instance 2-5 mm, which are mixed with a liquid binder, for instance polyurethane. The thus formed mixture can then be spread over substrate 2 using an asphalting machine or a paver specially developed for the purpose. It is also possible on the other hand to use as resilient and/or damping material 3 a foam material which is supplied on rolls and simply unrolled over the hard substrate 2.

As already indicated above, the known synthetic turf field 1 is exceptionally "bouncy" as a consequence of the presence of the layer of resilient and/or damping material 3, whereby in the case of ball games the bouncing behaviour of the ball is affected, which does not generally enhance the quality of the game. The excessive resilience and energy restitution of the synthetic turf field is moreover perceived by players as being unpleasant and tiring.

So as to obviate these problems, it is proposed according to the invention to form air chambers in the layer of resilient and/or damping material 3 or between the layer of resilient and/or damping material 3 and the relatively hard substrate 2.

Figure 2:
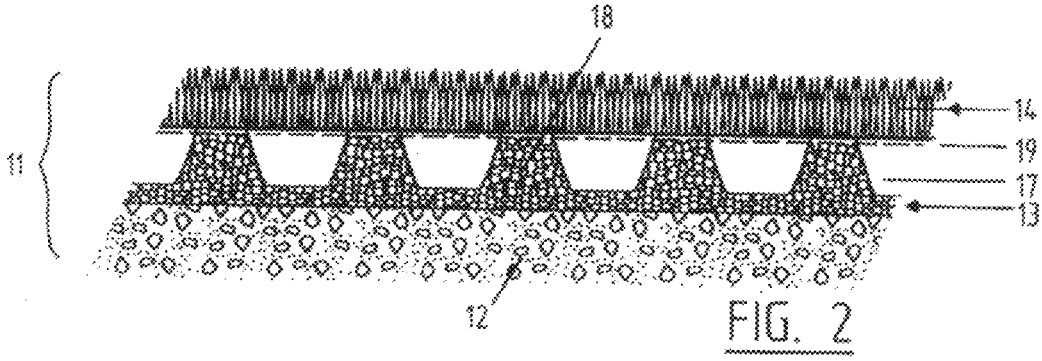
FIG. 2 to 6 show corresponding cross-sections through different embodiments of the playing field according to the invention.

According to a first variant of the invention, the air chambers 17 are formed in the upper part of the layer of resilient and/or damping material 13 (FIG. 2). For this purpose recesses are formed from the top in the resilient and/or damping layer 13. These recesses can take a random form, for instance be of circular cross-section. They are preferably distributed uniformly over the surface of the synthetic turf field 11. When the resilient and/or damping layer 13 consists of a mixture of rubber granules 18 and a binder, the recesses can be formed after the resilient and/or damping layer 13 has been arranged on the relatively hard substrate 12, but before it has hardened. A machine provided with protruding parts (not shown here) can for instance be moved for this purpose over the not yet hardened resilient layer 13. A profiled pressure roller can be envisaged here, whereby the recesses that will define the air chambers 17 are thus formed directly during pressing down of the resilient and/or damping layer 13. In this manner the forming of air chambers 17 does not require a separate operating run.

Figure 3:
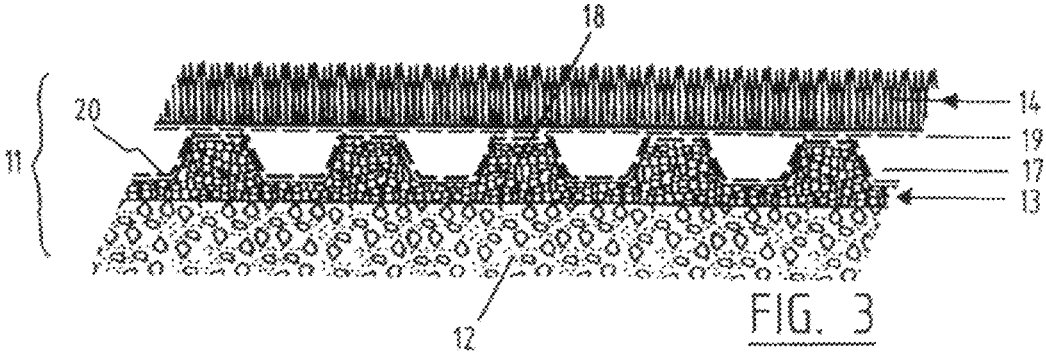

According to a variant of this method, air chambers 17 are formed by laying a profiled mat 20 on the resilient and/or damping layer 13 before this latter hardens, and by then pressing this mat 20 into the resilient and/or damping layer 13 (FIG. 3). Use can herein then be made of a standard roller or pressure roller without profile. Mat 20 can form a permanent part of the substrates, but could also be removed during curing of the resilient and/or damping layer. The mat could be manufactured for this purpose from a material with low melting point, and could therefore be easily removed by heating. The use of a biologically degradable material for mat 20 can also be envisaged.

In the shown embodiment another layer 19 is otherwise also arranged between the resilient and/or damping layer 13 and top layer 14, here in the form of a pressure distribution layer of a relatively stiff material, whereby the loads on top layer 14 are distributed evenly over the resilient and/or damping layer 13, and subsidence of top layer 14 at the position of air chambers 17 is prevented. A second flat resilient and/or damping layer could however also be arranged instead of a pressure distribution layer 19.

Heating wires of a conductive material could further be included in mat 20 or in the additional layer 19, which wires could be connected to one or more electrical power supplies along the edge of the playing field. In this way the playing field 11 can be heated in simple manner, whereby it remains readily playable, also in winter.

When the layer of resilient and/or damping material 13 is a foam material supplied on rolls, the recesses for the air chambers could be formed by local processing, either mechanically, thermally or chemically, of the upper side of the resilient and/or damping layer 13.

It is also possible to envisage the resilient and/or damping layer 13 being formed by a mixture of rubber granules 18 and binder which incorporates inclusions of a material which can be easily removed from the resilient and/or damping layer 13 after arranging thereof. It is for instance possible to envisage inclusions of a material with a low melting point, such as polystyrene granules, which after arranging of the resilient and/or damping layer 13 can be removed by heating this layer to above the melting point of the inclusions. Another possibility is the use of inclusions of a biologically degradable material which will decompose automatically after a period of time, whereby air chambers are again formed in the resilient and/or damping layer 13. The inclusions can herein be distributed over the whole layer 13, though it is also possible to envisage them being concentrated close to the top side, so that after heating or after decomposition of the material a pattern is created as according to FIGS. 2 and 3.

Figure 4:
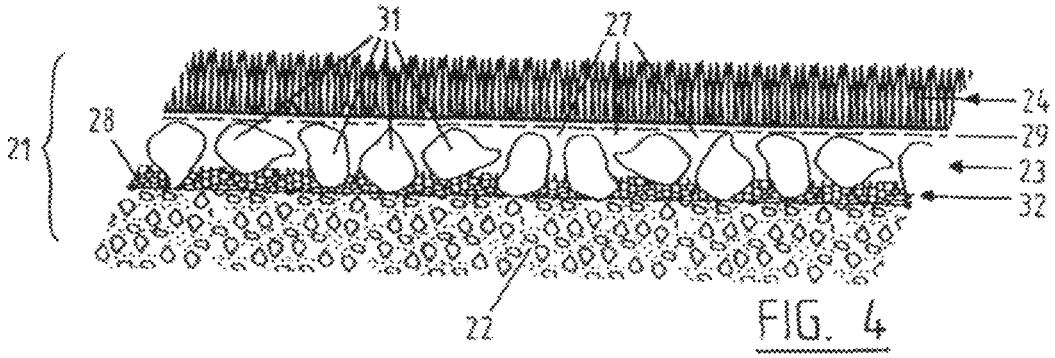

In another embodiment of the synthetic turf field 21 according to the invention (FIG. 4) the air chambers 27 are formed by intermediate spaces between relatively large granules 31 in the resilient and/or damping material. In the shown embodiment these granules 31 have dimensions which are almost the same as the thickness of the layer of resilient and/or damping material 23, although this is not always essential. For an optimal effect however, the granules 31 do have to have dimensions which are relatively large in proportion to the thickness of the layer of resilient and/or damping material 23. It is possible to envisage dimensions amounting to more than half the thickness of the resilient and/or damping layer 23, preferably more than 70% thereof, and more preferably more than 85% thereof. The resilient and/or damping layer 23 can be formed in this embodiment by first arranging on the relatively hard substrate 22 a relatively flat and thin adhesive layer 32 of resilient and/or damping material, consisting for instance of a mixture of relatively small granules 28 and binder or formed by a compact layer of polyurethane, and then scattering the relatively large granules 31 in this adhesive layer 32. A synthetic turf 24 can then in turn be laid on the relatively large granules 31, wherein on the top side of the resilient and/or damping layer 23 intermediate spaces are thus created which will function as air chambers 27. Also shown here is a pressure distribution layer 29 which, if desired, can be arranged between the resilient and/or damping layer 23 and top layer 24.

Figure 5:
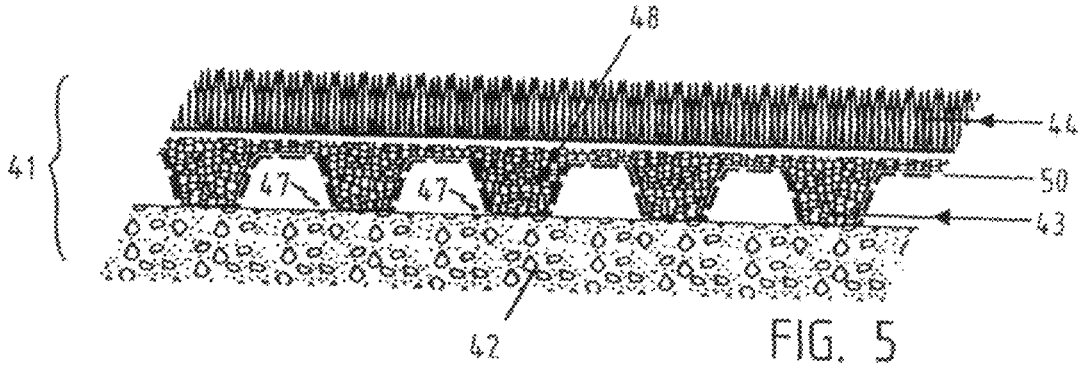
Figure 6:
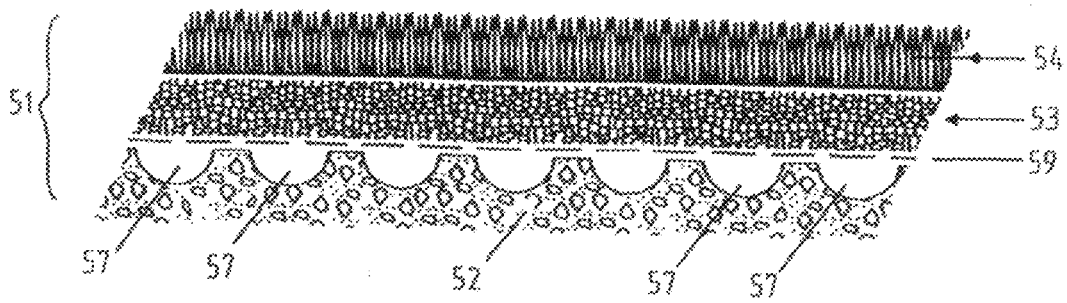

According to yet another variant of the invention the air chambers are formed by first laying on the relatively hard substrate 42 a profiled, at least initially form-retaining mat 50, the profile of which, together with substrate 42, defines air chambers 47 (FIG. 5). Mat 50 can be a woven fabric with a mesh width smaller than the grain size of the resilient and/or damping material 48 which is spread over the profiled mat 50 and is finished to form a flat layer. A synthetic turf 44 can then be arranged thereover. Heating wires can here also be incorporated in mat 50.

In yet another embodiment of synthetic turf field 51 according to the invention the air chambers 57 are likewise enclosed between the relatively hard substrate 52 and the resilient and/or damping layer 53, but are defined by recesses in the relatively hard substrate 52, while the resilient and/or damping layer 53 is substantially flat. The recesses in the upper part of the relatively hard substrate 52 can be formed in the same manner as the recesses in the resilient and/or damping layer 13 according to the first embodiment. A pressure distributing layer 59 can here optionally also be arranged between the relatively hard substrate 52 and the resilient and/or damping layer 53. A synthetic turf 54 is in turn laid on the flat layer of resilient and/or damping material 53, which in the shown embodiment consists of a plastic foam.

Although not show here, air chambers 17, 27, 47, 57 could be connected to means for generating an air circulation therein. These circulation means could be formed by one or more fans or compressors along the edge of the playing field with which air could be blown through air chambers 17, 27, 47, 57. If this air is first heated, a simple system of ground heating is thus created. The layer of resilient and/or damping material can, as stated, consist of a mixture of rubber granules and a binder such as polyurethane. In addition to the rubber granules, other plastic materials can also be used such as polystyrene granules, polyethylene foam, rubber foam, polyurethane foam and the like. In addition, use could be made in small part of stone chippings, thereby considerably reducing the cost of the resilient and/or damping layer.

Although the invention is elucidated above with reference to a number of embodiments, it will be apparent that it is not limited thereto, and that many modifications and adjustments are possible within the scope of the following claims. A further flat layer of resilient and/or damping material could for instance be arranged between the layer of resilient and/or damping material with the air chambers and the relatively hard substrate. In addition, the different variants of the layers with air chambers could be combined for an even better damping. The form and dimensions of the air chambers, their number and the distribution thereof over the playing field can further be varied as desired so as to arrive at the required degree of damping. Finally, other playing surfaces, such as floors of sports halls, athletic tracks and the like, can also be envisaged for application of the invention instead of synthetic turf fields. Even other types of surfaces suitable for walking on, such as floors in industrial premises or homes, could be provided with air chambers with the purpose of increasing comfort.

The scope of the invention is therefore defined solely by the claims.

The invention claimed is:

1. Method for laying a playable surface, in particular a playing field, comprising the steps of:

forming a relatively hard substrate with a horizontal, fiat top surface, arranging on the relatively hard substrate at least one layer of a resilient and/or damping material, and arranging a top layer on the at least one layer of resilient and/or damping material, wherein the at least one layer of resilient and/or damping material extends under the entire surface of the top layer, and wherein during or after arranging of the layer of resilient and/or damping material, permanent air chambers are formed therein, the permanent air chambers being embedded only in the at least one layer of resilient and/or damping material, the permanent air chambers not extending below the top surface of the relatively hard substrate, wherein the permanent air chambers are formed in the at least one layer of resilient and/or damping material by creating recesses therein from the top side after it is arranged, wherein the recesses are created by moving a machine provided with protruding parts over the at least one layer of resilient and/or damping material.

2. Method for laying a playable surface, in particular a playing field, comprising the steps of:

forming a relatively hard substrate with a horizontal, flat top surface, arranging on the relatively hard substrate at least one layer of a resilient and/or damping material, and arranging a top layer on the at least one layer of resilient and/or damping material, wherein the at least one layer of resilient and/or damping material extends under the entire surface of the top layer, and wherein during or after arranging of the layer of resilient and/or damping material, permanent air chambers are formed therein, the permanent air chambers being embedded only in the at least one layer of resilient and/or damping material, the permanent air chambers not extending below the top surface of the relatively hard substrate, wherein the permanent air chambers are formed in the at least one layer of resilient and/or damping material by creating recesses therein from the top side after it is arranged, wherein the recesses are created by pressing a profiled mat into the at least one layer of resilient and/or damping material.

3. Method as claimed in claim 1, wherein the air chambers are formed in the layer of resilient and/or damping material by removing material therefrom at different locations after the arranging thereof.

4. Method as claimed in claim 3, wherein inclusions of a material with low melting point are arranged in the layer of resilient and/or damping material which are removed by heating after the layer has been arranged.

5. Method as claimed in claim 3, wherein inclusions of a biologically degradable material are arranged in the layer of resilient and/or damping material which are removed by natural processes after the layer has been arranged.

6. Method as claimed in claim 1, wherein the air chambers are formed in the layer of resilient and/or damping material during arranging thereof by including granules having large dimensions relative to the thickness of the layer.

7. Method as claimed in claim 6, wherein the layer of resilient and/or damping material is arranged in two steps, by first arranging a relatively flat adhesive layer on the relatively hard substrate, and subsequently spreading the granules with large dimensions over the adhesive layer.

8. Method as claimed in claim 2, wherein prior to arranging of the mat heating wires are received therein.

9. Method for laying a playable surface, in particular a playing field, comprising the steps of:

forming a relatively hard substrate with a horizontal, flat top surface, arranging on the relatively hard substrate at least one layer of a resilient and/or damping material, and arranging a top layer on the at least one layer of resilient and/or damping material, wherein during or after arranging of the at least one layer of resilient and/or damping material permanent air chambers are formed therein, which air chambers are embedded only in the at least one layer of resilient and/or damping material and do not extend below the top surface of the relatively hard substrate, wherein the permanent air chambers are formed in the at least one layer of resilient and/or damping material by creating recesses therein from the top side after it is arranged, and wherein the recesses are created by moving a machine provided with protruding parts over the at least one layer of resilient and/or damping material.

10. Method for laying a playable surface, in particular a playing field, comprising the steps of forming a relatively hard substrate with a horizontal, flat top surface, arranging on the relatively hard substrate at least one layer of a resilient and/or damping material, and arranging a top layer on the at least one layer of resilient and/or damping material, wherein during or after arranging of the at least one layer of resilient and/or damping material permanent air chambers are formed therein, which air chambers are embedded only in the at least one layer of resilient and/or damping material and do not extend below the top surface of the relatively hard substrate, wherein the permanent air chambers are formed in the at least one layer of resilient and/or damping material by creating recesses therein from the top side after it is arranged, and wherein the recesses are created by pressing a profiled mat into the at least one layer of resilient and/or damping material.

11. Method of claim 9, wherein at least one other layer is also arranged between the at least one layer of resilient and/or damping material with the permanent air chambers and the top layer.

12. Method of claim 9, wherein the top layer is a synthetic turf.

13. Method of claim 9, wherein at least some of the permanent air chambers are connected to means for generating an air circulation therein.

14. Method of claim 10, wherein at least one other layer is also arranged between the at least one layer of resilient and/or damping material with the permanent air chambers and the top layer.

15. Method of claim 10, wherein the top layer is a synthetic turf.

16. Method of claim 10, wherein at least some of the permanent air chambers are connected to means for generating an air circulation therein.

* * * * *